United States Patent [19]

van de Pol

[11] Patent Number: 4,837,387

[45] Date of Patent: Jun. 6, 1989

[54] SUPPORTING FABRIC FOR BEARING BULK MATERIAL

[75] Inventor: Gustaaf M. W. van de Pol, Zevenaar, Netherlands

[73] Assignee: Akzo N.V., Arnhem, Netherlands

[21] Appl. No.: 16,584

[22] Filed: Feb. 19, 1987

[30] Foreign Application Priority Data

Feb. 21, 1986 [NL] Netherlands ..... 8600436

[51] Int. Cl.[4] ..... D03D 3/00

[52] U.S. Cl. ..... 428/229; 405/258; 428/225; 428/257; 428/258

[58] Field of Search ..... 405/258, 610, 262, 18, 405/19; 428/225, 257, 229, 258

[56] References Cited

U.S. PATENT DOCUMENTS 3,670,506 6/1972 Gaudard ..... 61/35
4,361,609 11/1982 Gerlach et al. ..... 428/225
4,472,086 9/1984 Leach ..... 428/257

FOREIGN PATENT DOCUMENTS 0024777 11/1981 European Pat. Off. .
1505395 3/1978 United Kingdom .
1559056 1/1980 United Kingdom .

*Primary Examiner*—James J. Bell
*Attorney, Agent, or Firm*—Stevens, Davis, Miller & Mosher

[57] ABSTRACT

The invention relates to supporting fabric, made of practically rightangularly crossing, synthetic yarns and having a width of at least 30 cm, preferably more than 1 m, and a length of at least 3 m, for geotextile uses, such as for bearing one or more layers of sand, gravel, stones, clay, loam, asphalt, mortar or like bulk materials. The fabric has a tensile strength in one or more directions of at least 50 kN/m. The yarns of the fabric are in the form of tapes or threads, the material of the yarn chiefly being formed of polypropylene incorporating a polyester, and preferably polyethylene terephthalate. As determined by the total weight of the yarn, the polypropylene composes 75%-85% of the yarn, by weight, and the polyester composes 15%-25% of the yarn, by weight.

16 Claims, 2 Drawing Sheets

SUPPORTING FABRIC FOR BEARING BULK MATERIAL

The present invention discloses a supporting fabric, made up of preferably substantially rightangularly crossing, substantially synthetic yarns. The fabric has a width of at least 30 cm, preferably more than 1 m, and a length of at least 3 m, for stationary geotextile and/or constructional uses, such as for bearing one or more layers of sand, gravel, stones, clay, loam, asphalt, mortar or like bulk materials to a height of at least 5–10 mm, the fabric having a tensile strength in one or more directions of at least 50 kN/m.

A comparable supporting fabric is disclosed in EP No. 0 024 777 and the article "Kunststofweefsels in de praktijk" by Ir. J. H. van Leeuwen in "Land+Water", No. 7/8, 1975. These known fabrics are often successfully used in building road, dam or dike embankments on a subsoil having a low bearing capacity. On this low bearing capacity subsoil there is laid a supporting fabric on which subsequently a structure of sand, stones, clinker or other bulk material is formed. The embankment of bulk material may widely vary according to the locality and the structure to be made, such as simple road surfacing, a motorway, a dike or a breakwater in the sea. For instance, the height of the layer of bulk material may range from about twenty cm to 10–20 m. The use of a supporting fabric on a subsoil and/or as intermediate layer leads to improved stability of the raised structure and a proper, permanent separation between the subsoil and the raised structure. Furthermore, the load distributing effect of the supporting fabric results in a reduction of point-to-point differences in consolidation, so that a re-distribution of stresses is obtained. The use of the known supporting fabric as a soil stabilizing means consequently leads to considerable economic savings, compared with the conventional non-geotextile method.

Of the commercially available supporting fabrics the warp yarns, which take up practically the entire loads, may be polyester multifilament yarns, and the weft yarns are generally multifilament yarns of the same material or some different material, such as polyamide or polypropylene. Although in actual practice the well-known supporting fabrics of polyester warp and/or weft yarns are applied on a large scale and are found quite satisfactory, also commonly used are warp yarns and possibly also weft yarns of tape yarns of polypropylene. A disadvantage to supporting fabrics containing polypropylene warp yarns, however, is that the creep of the fabric in load direction is very high. The creep of a fabric is the deformation of material, particularly the extension of the material, due to static loading. The magnitude of the creep is expressed as percentage extension with time, typically the time being a period of 1 year or 10 years.

Because in actual practice the creep of a supporting fabric is one of the most important properties, obviously the high creep of a polypropylene supporting fabric limits its utility.

It should be added that FR No. 2 265 913 describes a fabric for use underneath the ballast bed of an asphalt paving. It also discloses fabrics of polyesters, polyamides or polyolefins.

Further FR No. 2 276 427 describes for reinforcing the subsoil of a road or an embankment an interwoven fabrication of crossing strips may be placed on the subsoil. These strips are of polyester monofilaments.

DOS No. 1 965 737 describes a non-woven web of polyester filaments for the stabilization of the subsoil.

There is the impression that the creep of a polypropylene supporting fabric may be 100 times as high as that of a supporting fabric of polyester multifilament yarns, depending on the acting load in relation to the breaking load.

The object of the present invention is to provide a supporting geotextile fabric, which does not display the disadvantage of the prohibitively high creep of a supporting fabric entirely formed of polypropylene. The supporting fabric of the invention is made of yarns which are primarily in the form of tapes and/or threads, the material of the yarn being made of polypropylene incorporating polyester, and preferably polyethylene terephthalate. Polypropylene is present in the yarn in an amount of 75 to 85 percent by weight, and preferably 80 percent by weight, and polyester is present in an amount of 25 to 15% by weight, preferably about 20% by weight, based on the total weight of the tapes or threads. In a preferred embodiment the polyester as a large number of bulk of the fibrils is present in the bulk of the polypropylene. In the preferred embodiment, and particularly in warp direction, the fabric has a tensile strength of 50 to 1000 kN/m, preferably 75 to 600 kN/m, and that in the same directions the elongation at rupture is 5 to 20%, preferably about 8–20%. A supporting fabric made of warp and weft yarns having a tensile strength in weft direction of at least 15 kN/m typically has a mass of 150 to 2500 g/m$^2$, preferably about 200 to 1000 g/m$^2$. Superior performance of geotextile fabric made of yarns, and especially warp yarns, that are in the form of tape. Such yarn, for example, may be a single, twisted and fibrillated tape having a thickness of about 60 to 100 $\mu$m and a width of at least 0,5 mm, and preferably 1 to 150 mm. Such yarns optimally have a linear density of the yarns, and more particularly the weft yarns of the fabric, in the range of about dtex 1500 to 25000.

Surprisingly, it has been found that the creep properties of the supporting fabric according to the invention are considerably better than those of well-known, wholly polypropylene supporting fabric.

The creep of a supporting fabric according to the present invention, using tape yarn made of 80% by weight polypropylene and 20% by weight polyethylene terephthalate, is about 10 times lower that of a well-known, 100%-polypropylene supporting fabric. It is therefore possible for the supporting fabric according to the present invention to be loaded to 30–35% of the tensile strength or breaking load for those uses where resistance to creep is an essential property of the fabric. The well-known, 100%-polypropylene supporting fabric, however, can in actual practice only be loaded up to about 20% of the tensile strength or breaking load. Moreover, with a supporting fabric according to the invention the weaving efficiency is higher, as a result of which the strength of the supporting fabric is 2.5 times that of the well-known polypropylene supporting fabric. Consequently, the functional strength of a supporting fabric according to the present invention is 3.5 to 5 times that of the well-known, 100%-polypropylene supporting fabric.

It should be noted that some properties of the supporting fabric according to the present invention, such as tensile strength and creep, are somewhat less favorable than those of a supporting fabric of of polyester multifilament yarns. On the other hand the supporting fabric of tape yarn according to the invention is considerably less susceptible to damage than the well-known supporting fabric of polyester filament yarns, and the supporting fabric according to the invention has a more robust appearance.

Rather surprisingly, due to its various properties, a supporting fabric of the present invention is cheaper, per unit strength (i.e., lower price per useful kN/m) than the well-known wholly polypropylene or wholly polyester supporting fabric.

The supporting fabric according to the present invention may advantageously use a plain weave or a twill weave. For relatively heavy loads a woven supporting fabric using warp and weft yarns according to an embodiment of the present invention uses both straight warp yarns and binder warp yarns. The straight warp yarns have a higher tensile strength than the binder warp yarns. When the fabric is subjected to a tensile load in the warp direction the straight warp yarns bear a higher proportion of the tensile load, about 80%, than the binder warp yarns. The linear density of the straight warp yarns may be at least five times, and preferably ten to forty times, higher than the linear density of the binder warp yarns.

In various uses a supporting fabric according to the present invention must be properly water permeable, but the meshes in the material must be dimensioned appropriately for the conditions under which it is to be used, so that no bulk material can pass through them. When the bulk material is sand, use may be made of meshes measuring, for instance, about $0.1\times0.1$ mm to $0.5\times0.5$ mm, depending on the grade limits of the sand.

The afore mentioned tensile strength and elongation at rupture are determined in accordance with DIN 53857, be it that beforehand a pretension is applied until the supporting fabric has undergone 1% deformation.

As to the state of the art it should be added that fibrillated or non-fibrillated tape yarns 80% weight of propylene and 20% by weight polyethylene terephthalate from which the supporting fabric according to the invention is made are known in themselves from GB No. 1 559 056.

The invention will be further described with reference to the accompanying schematic drawing.

Figure 1:
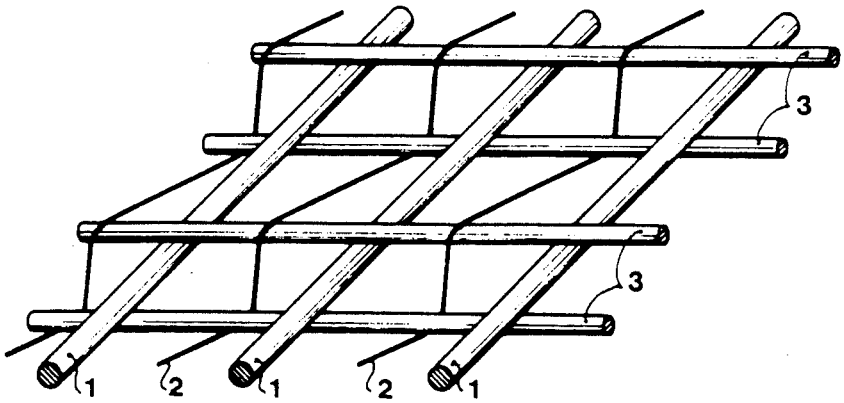
FIG. 1 is a view in perspective of the supporting fabric according to the invention.
Figure 2:
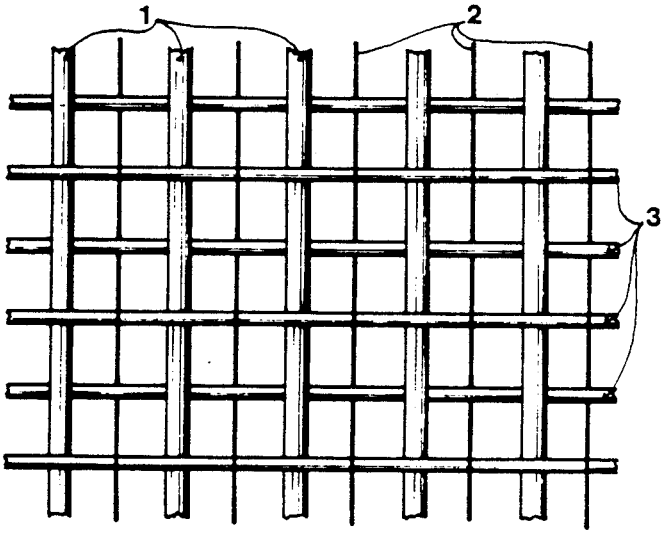
FIG. 2 is a plan view of the fabric of FIG. 1.
Figure 3:
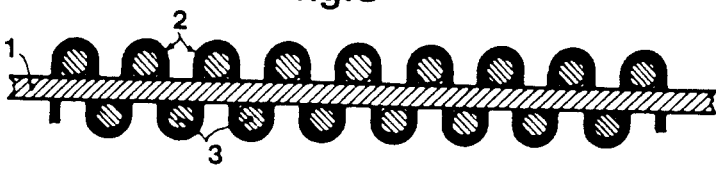
FIG. 3 is a cross-sectional view of the supporting fabric according to the invention.

The supporting fabric according to the invention shown in FIGS. 1 and 2 has a plain weave pattern and is formed by straight warp yarns 1, binder warp yarns 2 and weft yarns 3. FIG. 3 shows this fabric in cross-section, like parts being referred to by the same numerals as given in FIGS. 1 and 2. As appears from the drawings, the straight warp yarns 1 extend practically rectilinearly in the fabric, whereas the binder warp yarns 2 strongly wind about the weft yarns 3. As the heavy straight warp yarns extend practically linearly in the supporting fabric, they will show a contraction of as little as 0–2%, i.e. straight warp yarns not present in the fabric will only be 0–2% longer than the straight warp yarns contained in the fabric. When a supporting fabric according to the invention is subjected to a tensile load in warp direction the fabric elongation will consequently be very small. As shown in the drawing, the binder warp yarns 2 have a much higher contraction. The contraction of the binder warp yarns is generally in the range of 25 to 70%.

In a supporting fabric as depicted in FIGS. 1, 2 and 3 with a plain weave but of the straight warp type, i.e. straight warp and binder warp yarns, the straight warp yarns 1 may each consist of, for instance, a single fibrillated tape of a linear density of dtex 25000 to 50000. These tapes are 80% by weight polypropylene and 20% by weight polyethylene terephthalate (petp). In the non-twisted state these tapes have a thickness of 60 to 100 μm and a width of 1 to 150 mm.

Several kinds of warp yarns may be used in the present invention. The binder warp yarns 2 may each consist of a single non-fibrillated type having a linear density of dtex 800 to 1200 and a width of 1 to 4 mm. Alternatively, the binder warp yarns may consist 80% by weight of polypropylene and 20% by weight polyethylene terephthalate. Other possible binder warp yarns may be multifilament or monofilament yarns of nylon 6 or petp. Another suitable binder warp yarn is a wholly propylene tape yarn. The binder warp yarns 2 are considerably lighter than the straight warp yarns 1. When tapes are used as warp yarns in the supporting fabric, they are twisted typically 10 to 50 turns per meter.

The weft yarns 3 also may each consist of a single non-fibrillated tape having a linear density of dtex 5000 or higher and a width in the non-twisted state of 1 to 150 mm. The weft yarns also may consist of 80% by weight polypropylene and 20% by weight polyethylene terephthalate. Also for the weft yarns other yarns may be used, such as multifilament or monofilament yarns of nylon 6, such as a nylon 6, or petp yarn of the dtex 940 f140 Z180 type. Another suitable weft yarn is a 100%-polypropylene tape yarn.

Figure 4:
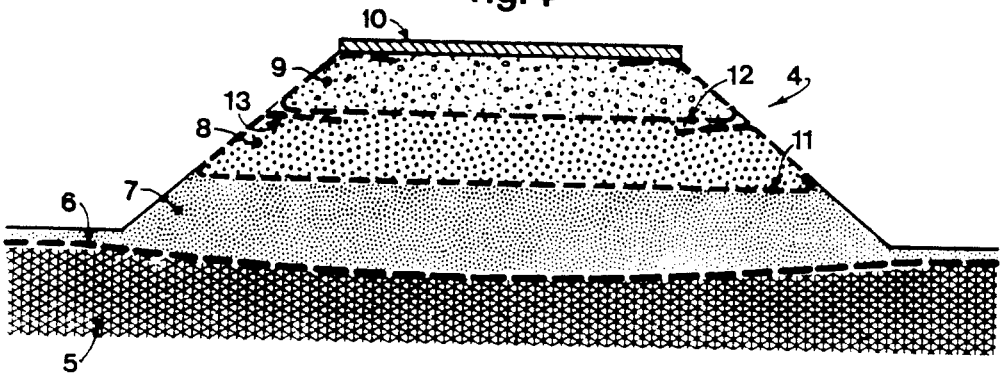
FIG. 4 is a cross-sectional view of a road embankment.

FIG. 4 shows a cross-section of a road embankment 4. The building of a road embankment first requires covering a subsoil 5 of low bearing capacity with a supporting fabric 6 in such a way that the warp direction of the material is transverse to the longitudinal direction of the road embankment. Subsequently, different layers of bulk material in this example three layers 7, 8 and 9, are dumped onto the supporting fabric. The top layer 9 is provided in the usual manner with a road surface 10. A supporting fabric 6 thus placed in the foundation of the road embankment has a stabilizing effect until the subsoil has sufficiently consolidated for it to have a higher bearing capacity. This may lead to a considerable economy on the cost of building a road. Optionally, the supporting fabrics 11 and 12 according to the invention may be placed between the boundary surfaces of the three layers of bulk material 7, 8 and 9. Further, the ends of the supporting fabrics 11 and 12 may be folded inwards, as indicated with the broken line 13.

The favorable properties of the supporting fabric according to the present invention will be illustrated with a few examples of which the data and measuring results are summarized in the following table.

TABLE

| Properties of the supporting fabric | Supporting fabric according to the invention I | II | III | Conventional supporting fabric type A, warp and weft 100% polypropylene | Conventional supporting fabric type B, warp of polyethylene terephthalate weft of polyamide 6 |
|---|---|---|---|---|---|
| weight (g/m²) | 568 | 633 | 500 | 720 | 460 |
| Warp direction | | | | | |
| Tensile strength | 288 | 256 | 230 | 230 | 235 |
| Elong. at rupture (%) | 17,8 | 11 | 11 | 17 | 9 |
| Weaving efficiency (%) | 90 | 90 | 90 | 80 | 86 |
| Density (threads/cm) | 5,0 | 4,5 | 5,0 | 4 | 33 |
| Weft direction | | | | | |
| Tensile strength | 91,5 | 50 | 50 | 40 | 54 |
| Elong. at rupture (%) | 12,2 | 7,6 | 11 | 10 | 23 |
| Weaving efficiency (%) | 91 | 85 | 85 | 80 | 85 |
| Density (threads/cm) | 2,0 | 2,0 | 2,0 | 2 | 4,5 |

For comparison the table gives several properties of supporting fabrics I, II and III according to the present invention along with those of two commercially available supporting fabrics A and B. For the supporting fabrics I, II, III and A a plain weave was used. For the supporting fabric B, however, use was made of a 6-ends filling rib.

In the supporting fabric I according to the present invention, use is made both in warp and in weft direction of a single tape, each tape having a linear density of dtex 7500 and consisting of 80% by weight polypropylene and 20% by weight polyethylene terephthalate. The tapes are twisted to 45 turns/m.

In the supporting fabric II according to the present invention both the warp yarns and the weft yarns each consist of a single tape containing 80% by weight polypropylene (PP) and 20% by weight polyethylene terephthalate (PETP). Each warp tape has a linear density of dtex 11100 and a twist of 45 t/m. The linear density of each of the weft tapes is dtex 5000 and the twist 0 t/m.

Also in the supporting fabric III according to the present invention both the warp yarns and the weft yarns each consist of a single tape containing 80% by weight polypropylene (PP) and 20% by weight polyethylene terephthalate (PETP). The linear density each of the warn yarns is dtex 7400 and the twist is 45 t/m. The linear density of each of the weft tapes is dtex 5000 and the twist 0 t/m.

In the conventional supporting fabric A both the warp and the weft are 100%-polypropylene yarns. The warp yarns each consist of a single tape having a linear density of dtex 16000 and a twist of 45 t/m. The weft yarns each consist of a single tape having a linear density of dtex 5500 and a twist of 0 t/m.

In the conventional supporting fabric B, use is made of polyethylene terephthalate dtex 1100 f210 warp yarns having a twist of 130 t/m. The weft yarns are of polyamide dtex 1880 f280 and have a twist of 0 t/m. Both the warp and the weft use is made of multifilament yarns.

Comparison of the properties of the supporting fabrics III, A and B in the table shows that in the representative warp direction and at approximately equal tensile strength the supporting fabric according to the present invention is considerably superior to the 100%-polypropylene supporting fabric A regarding weight (g/m²) and weaving efficiency.

Of the warp yarns in the supporting fabrics mentioned in the table the creep in 1 month was measured under a load of the order of 50% of the breaking load and the following values were obtained:

| | |
|---|---|
| Creep of warp tapes of 80% PP and 20% PETP: (supporting fabrics I, II, III according to the invention) | 5,9% |
| Creep of warp tapes of 100% PP: (supporting fabric A not according to the invention) | 51,2% |
| Creep of multifilament yarns of 100% PETP: supporting fabric B not according to the invention) | 0,5% |

The creep of the fabrics made from these yarns is typical, so it may be concluded that the creep property of a supporting fabric according to the present invention is far superior to a fabric wholly made of propylene tape yarns. It is surprising that the addition of a relatively small amount of 20% by weight PETP results in a decrease of the creep by a factor 8,7=51.2/5.9 over a supporting fabric wholly made of PP warp tapes.

By weaving efficiency it is meant the ratio between the tensile strengths of a fabric and the sum of the tensile strengths of the yarns contained in that fabric, expressed on a percentage basis.

Within the scope of the present invention various modifications may be made. For instance, the weft yarns of the supporting fabrics use may be yarns textured by means of air or in some other way. In building concrete structures or foundations, use may be made of a supporting fabric according to the present invention for bearing concrete or cement mortar as flexible form work.

I claim:

1. A supporting woven fabric, having a warp axis and a orthogonal weft axis, for stationary geotextile uses, such as for bearing one or more layers of sand, gravel, stones, clay, loam, asphalt, mortar or the like bulk or other material, to a height of at least 5–10 mm, the fabric having a tensile strength along at least one of the warp axis or weft axis of at least 50 kN/m, comprises of synthetic yarns having a weight, the yarn being composed of polypropylene incorporating polyester, and the polypropylene is used in an amount of 75 to 85 percent by weight, and the polyester is used in an amount of 25 to 15% by weight, based on the total weight of the synthetic yarn.

2. A fabric according to claim 1, wherein the polypropylene is used in an amount of 80% by weight, and the polyester in an amount of 20% by weight.

3. A fabric according to claim 1, wherein the polyester is incorporated in the polypropylene in the form of a large number of fibrils.

4. A fabric according to claim 1, wherein along at least one axis, particularly the warp axis, the fabric has a tensile strength of 50 to 1000 kN/m.

5. A fabric according to claim 1, wherein, along at least one axis, particularly the warp axis, the fabric has an elongation at rupture of 5 to 20%.

6. A supporting fabric according to claim 1, wherein the tensile strength of the fabric along the weft axis is at least 15 kN/m, and the fabric has a mass of 150 to 2500 g/m$^2$.

7. A fabric according to claim 1, wherein the yarns parallel to the warp axis are a untwisted tape having a thickness of 60 to 100 m and a width of 0.5 mm to 150 mm.

8. A fabric according to claim 1, wherein the yarns, parallel to the warp axis having a linear density of dtex 1500 to 75000.

9. A fabric according to claim 1, wherein the yarns extending along the warp axis of the fabric are straight warp yarns and binder warp yarns, the straight warp yarns each having a higher strength than the binder warp yarns.

10. A fabric according to claim 9, wherein the linear density of each of the straight warp yarns is at least five times, as high as the linear density of the binder warp yarns.

11. A fabric according to claim 10, wherein the linear density of the straight warp yarns is 10 to 40 times as high as that of the blender warp yarns.

12. A fabric according to claim 1, wherein the polyester is polyethylene terephthalate.

13. A fabric according to claim 1, wherein the yarn is a tape.

14. A fabric according to claim 1 where the yarn is thread.

15. A fabric according to claim 4, wherein the tensile strength is 75 to 600 kN/m.

16. A fabric according to claim 6, wherein the fabric has a mass of 200 to 1000 g/m$^2$.

* * * * *

UNITED STATES PATENT AND TRADEMARK OFFICE

CERTIFICATE OF CORRECTION

PATENT NO. : 4,837,387

DATED : June 6, 1989

INVENTOR(S) : Gustaaf M. W. van de Pol

It is certified that error appears in the above-identified patent and that said Letters Patent is hereby corrected as shown below:

Claim 1, line 64; "comprises" should read --comprised--.

Signed and Sealed this

Eighth Day of May, 1990

*Attest:*

HARRY F. MANBECK, JR.

*Attesting Officer*

*Commissioner of Patents and Trademarks*